US006072449A

United States Patent [19]

Amemiya

[11] Patent Number: 6,072,449

[45] Date of Patent: Jun. 6, 2000

[54] METHOD OF DRIVING A SURFACE-DISCHARGE TYPE PLASMA DISPLAY PANEL

[75] Inventor: Kimio Amemiya, Yamanashi-ken, Japan

[73] Assignee: Pioneer Electronic Corporation, Tokyo, Japan

[21] Appl. No.: 09/034,246

[22] Filed: Mar. 4, 1998

[30] Foreign Application Priority Data

Mar. 5, 1997 [JP] Japan ..... 9-67347

[51] Int. Cl.[7] ..... G09G 3/28

[52] U.S. Cl. ..... 345/67; 345/68

[58] Field of Search ..... 345/60, 62, 67, 345/68; 315/169.4

[56] References Cited

U.S. PATENT DOCUMENTS 4,190,788 2/1980 Yoshikawa et al. ..... 315/169.4

4,833,463 5/1989 Dick et al. ..... 315/169.4

*Primary Examiner*—Steven J. Saras

*Assistant Examiner*—Tewolde Mengisteab

*Attorney, Agent, or Firm*—Arent Fox Kintner Plotkin & Kahn PLLC

[57] ABSTRACT

A method of driving a surface-discharge type plasma display panel, comprises: providing an address period for selecting picture elements to be lighted and picture elements not to be lighted in accordance with displaying data; providing a discharge maintaining period for alternatively applying discharge maintaining pulses to first and second maintaining electrodes so as to maintain the lighted picture elements and the not-lighted picture elements; applying two discharge maintaining pulses having different phases to every two second maintaining electrodes between which there is a first maintaining electrode serving as a common electrode for the two second maintaining electrodes.

6 Claims, 10 Drawing Sheets

IPY1

Y1
(Y4)
0
IPX

X1,2
(X3,4)
0

IY1
(IY4)
0
IPY2

Y2
(Y3)
0
IPX

X1,2
(X3,4)
0

IY2
(IY3)
0

IX1,2
(IX3,4)
0

IPY1

Y1
(Y4)
0
IPX

X1,2
(X3,4)
0

IY1
(IY4)
0
IPY2

Y2
(Y3)
0
IPX

X1,2
(X3,4)
0

IY2
(IY3)
0

IX1,2
(IX3,4)
0

$Y_1$ ($Y_{4,5}$)

$X_{1,2}$ ($X_5$)

$I_{Y_1}$ ($I_{Y_1} - X_{1,2}$)

$Y_{2,3}$ $X_{1,2}$ $I_{Y_{2,3}} - X_{1,2}$ $Y_{4,5}$ $X_{3,4}$ $I_{Y_{4,5}} - X_{3,4}$ $Y_{2,3}$ $X_{3,4}$ $I_{Y_{2,3}} - X_{3,4}$
0
$IP_{Y_1}$
$IP_{X_1}$
$IP_{Y_2}$
$IP_{X_2}$

FIG.8(a) $Ix_{1,2}$ 0
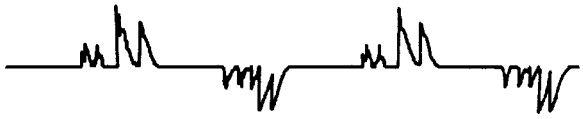
FIG.8(b) $Iy_{2,3}$ 0
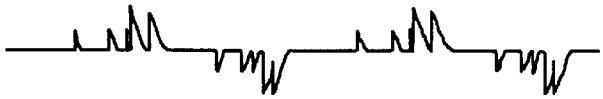
FIG.8(c) $Ix_{3,4}$ 0
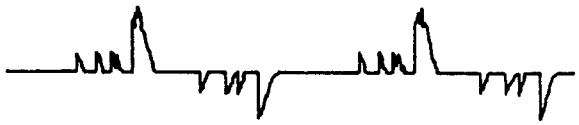
FIG.8(d) $Iy_{4,5}$ 0
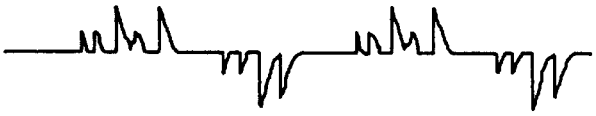

METHOD OF DRIVING A SURFACE-DISCHARGE TYPE PLASMA DISPLAY PANEL

BACKGROUND OF THE INVENTION

The present invention relates generally to a method of driving a plasma display panel, particularly to a method of driving a surface-discharge type plasma display panel.

A surface-discharge type plasma display panel is formed by alternatively placing a plurality of maintaining electrodes X,Y on the inner surface of a single identical substrate.

However, in the above-described structure, since an electrode X and an electrode Y are situated adjacent to one another between two displaying lines, an electric potential difference occurs between two displaying lines during a sustain period. In order to prevent undesired panel discharge, it is necessary to enlarge a space between every two displaying lines. However, since a pitch between every two displaying lines has to be enlarged, it is difficult to produce a plasma display panel having a compact structure with a high precision.

In order to solve the above problem, there has been suggested an improved electrode arrangement as shown in FIG. 10. As shown in FIG. 10, maintaining electrodes X, Y are arranged in a manner such that their mutual positional relationship is alternatively changed from one displaying line L to another. Further, each maintaining electrode X receiving an identical drive signal is positioned between two adjacent maintaining electrodes Y (such as Y1 and Y2, Y3 and Y4) being driven selectively and successively. The maintaining electrodes X and maintaining electrodes Y are provided on the inner surface of a front substrate. Each of maintaining electrodes X and Y comprises a transparent electrode 4 consisting of a transparent electrically conductive film, and a bus electrode 3 (metal electrode) consisting of laminated metal layers for improving the electrical conductivity of the transparent electrode 4.

When such a surface-discharge type plasma display panel is driven, a unit displaying period is divided into an address period and a sustain period. During the address period, either a selective writing address method or a selective erasing address method is used, so that wall electric charges are accumulated in discharging cells (to be lighted) successively from one displaying line to another. During the sustain period as shown in FIG. 11, discharge maintaining pulses having the same phases are alternatively applied to maintaining electrodes X, Y on all the displaying lines, so as to effect a desired discharge emission.

However, with an electrode arrangement shown in FIG. 10 where each maintaining electrode X is positioned between two adjacent maintaining electrodes Y (for example, Y1 and Y2, Y3 and Y4), when discharge maintaining pulses IPx and IPy are applied to the maintaining electrodes (X,Y), an electric current $IX_{1,2}$ (displacement current, discharging current) flowing through the maintaining electrode ($X_{1,2}$) will become a value including currents $IY_1$, $IY_2$ flowing through adjacent maintaining electrodes $Y_1$ and $Y_2$. As a result, a peak electric current will be considerably large.

Consequently, if a voltage drop on a bus electrode 3 is large and a width of a bus electrode 3 is narrow, the plasma display panel will have a deteriorated displaying quality.

On the other hand, if a width $W_2$ of a bus electrode 3 on a maintaining electrode $X_{1,2}$ is larger than a width $W_1$ of a bus electrode 3 on an adjacent maintaining electrode Y (Y1 or Y2), it is sure that a voltage drop on the bus electrode 3 on maintaining electrode $X_{1,2}$ will be small. However, with a plasma display panel in which all the maintaining electrodes are positioned on an inner surface of a front substrate, there will be a problem that a numerical aperture is small and an emission efficiency is low due to a fact that light is obstructed by the bus electrodes 3.

SUMMARY OF THE INVENTION

It is an object of the present invention to provide an improved method of driving a surface-discharge type plasma display panel to obtain an improved displaying quality, so as to solve the above-mentioned problems peculiar to the above-mentioned prior arts.

According to the present invention, there is provided a method of driving a surface-discharge type plasma display panel. Such a plasma display panel comprises a plurality of displaying lines each including a first maintaining electrode and a second maintaining electrode to form a discharge gap therebetween, a dielectric layer coverring the first and second maintaining electrodes, a plurality of address electrodes arranged in a direction orthogonal to the first and second maintaining electrodes to form a plurality of picture elements. A method of driving the above plasma display panel comprises: providing an address period for selecting picture elements to be lighted and picture elements not to be lighted in accordance with displaying data; providing a discharge maintaining period for alternatively applying discharge maintaining pulses to first and second maintaining electrodes so as to maintain lighted picture elements and not-lighted picture elements; applying two discharge maintaining pulses having different phases to every two second maintaining electrodes between which there is a first maintaining electrode serving as a common electrode for the two second maintaining electrodes, or applying two discharge maintaining pulses having different phases to every two second maintaining electrodes between which there are two first maintaining electrodes electrically connected together through at least one connecting means.

According to one aspect of the present invention, each of a first maintaining electrode and a second maintaining electrode is comprised of a transparent electrically conductive film and a metal film laminated over the transparent electrically conductive film.

According to another aspect of the present invention, each transparent electrically conductive film has a plurality of protruding portions, in a manner such that on each displaying line the protruding portions of first and second maintaining electrodes are facing each other with a discharging gap therebetween.

The above objects and features of the present invention will become more understood from the following description with reference to the accompanying drawings.

BRIEF DESCRIPTION OF DRAWINGS

FIGS. 8*a*–8*d* are graphs indicating different discharging currents caused by different driving waves.

DETAILED DESCRIPTION OF THE PREFERRED EMBODIMENTS

Figure 1:
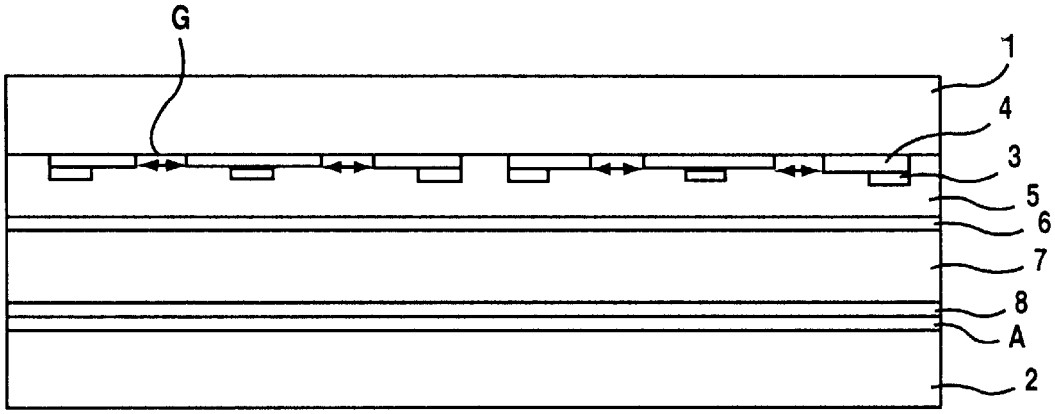
FIG. 1 is a cross sectional view schematically illustrating a surface-discharge type plasma display panel to be driven in a method according to one embodiment of the present invention.

FIG. 1 is a cross sectional view illustrating a plasma display panel to be driven in a method according to a first embodiment of the present invention.

As illustrated in FIG. 1, the plasma display panel has a front substrate 1 and a rear substrate 2, which are facing each other with a discharging space 7 formed therebetween.

Referring again to FIG. 1, the front substrate 1 has on its inner surface a plurality of row electrode pairs (including first maintaining electrodes and second maintaining electrodes) arranged in parallel with one another. A dielectric layer 5 for producing wall charges is formed to cover the plurality of row electrode pairs. Further, a protection layer 6 made of MgO is formed to protect the dielectric layer 5.

Figure 2:
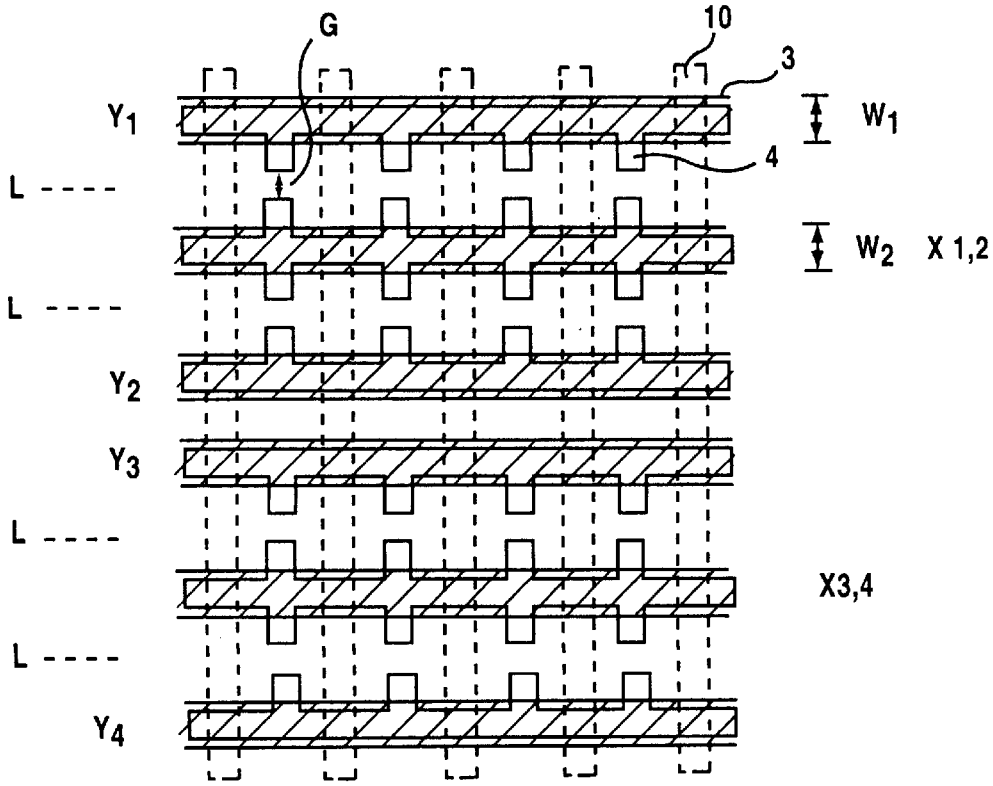
FIG. 2 is a plane view schematically illustrating the structure of the surface-discharge type plasma display panel of FIG. 1.
Figures 3A, 3B, 3C, 3D, 3E, 3F, 3G:
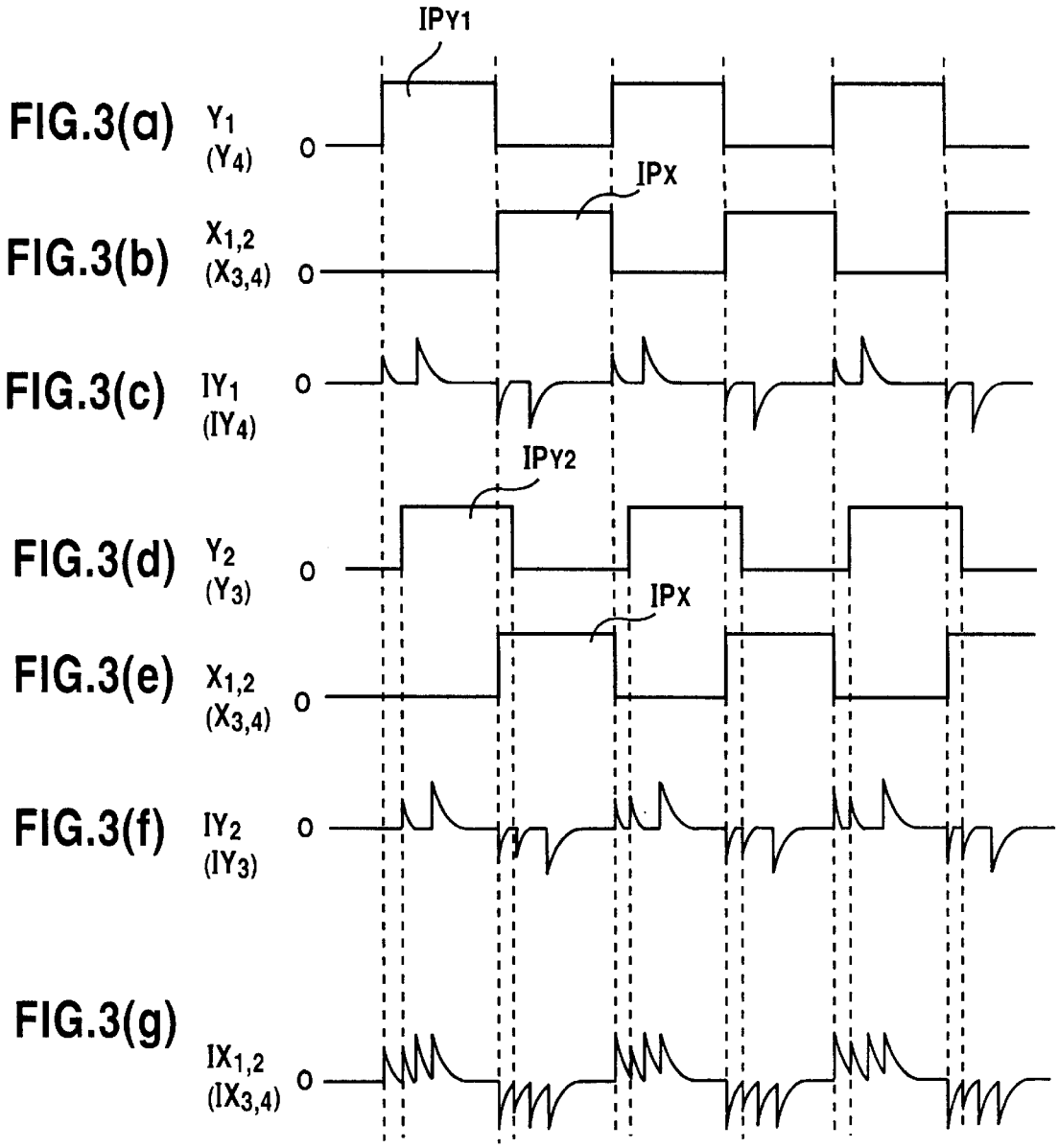
FIGS. 3*a*–3*g* are graphs indicating driving waves for driving the surface-discharge type plasma display panel of FIG. 2.
Figures 4A, 4B, 4C, 4D, 4E, 4F, 4G:
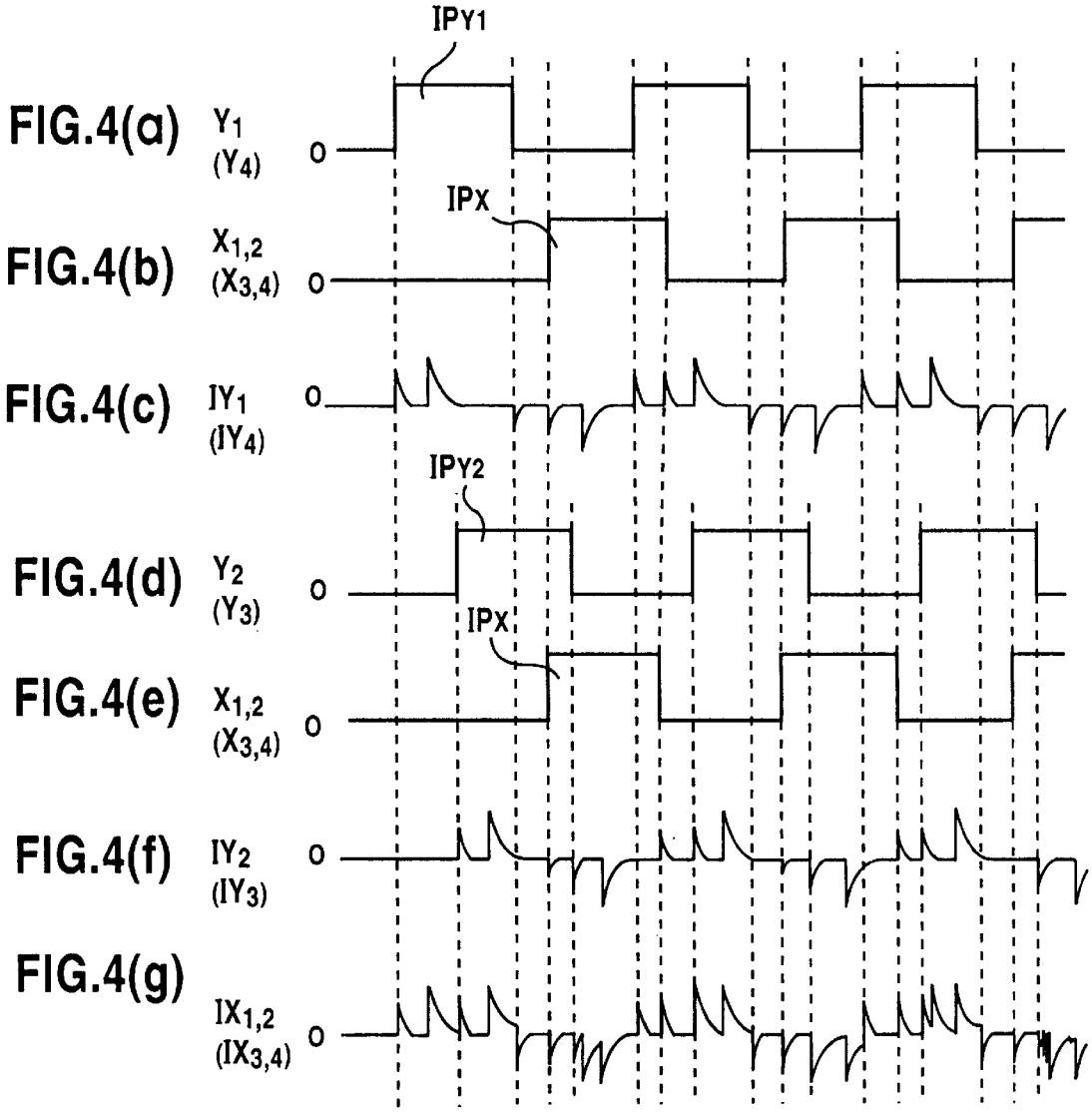
FIGS. 4*a*–4*g* are graphs indicating driving waves for driving the surface-discharge type plasma display panel of FIG. 2.

FIG. 2 is a plane view illustrating an arrangement of the row electrode pairs (including first maintaining electrodes and second maintaining electrodes) of the plasma display panel of FIG. 1.

Referring to FIG. 1 and FIG. 2, each row electrode pair includes a first maintaining electrode X and a second maintaining electrode Y. Each of a first maintaining electrode X and a second maintaining electrode Y comprises a transparent electrode 4 consisting of a transparent electrically conductive film, and a bus electrode 3 (metal electrode) consisting of a laminated metal layer for improving the electrical conductivity of the transparent electrode 4.

On the other hand, the rear substrate 2 has on its inner surface a plurality of partition walls (not shown) which are arranged in a direction orthogonal to the row electrode pairs (X,Y), thereby rendering the discharging space 7 to be divided into a plurality of elongate sub-spaces. The elongate sub-spaces accommodate column electrodes A (address electrodes) arranged in a direction orthogonal to the row electrode pairs (X, Y). In addition, a fluorescent material layer 8 including three primary colours (Red, Green, Blue) is provided to cover the partition walls (not shown) and the column electrodes A.

Then, a discharging gas containing neon and a small amount of xenon is sealed into the discharge space 7. Thus, a plurality of discharge cells (picture elements) are formed by way of intersection of the row electrode pairs (X,Y) with the column electrodes A.

Referring again to FIG. 2, a first and a second maintaining electrodes (X,Y) which together form a row electrode pair on a displaying line L, have their mutual positional relationships changed alternatively from one displaying line L to another. Maintaining electrodes X (for example, $X_{1,2}$ and $X_{3,4}$) which receive an identical drive signal, are each positioned between two adjacent maintaining electrodes Y (for example, $Y_1$,$Y_2$ and $Y_3$,$Y_4$) which are successively and selectively driven. Thus, each maintaining electrode (for example, $X_{1,2}$) serves as a common electrode (equal to two maintaining electrodes X) for every two adjacent maintaining electrodes (for example, $Y_1$, $Y_2$).

Referring to FIG. 2, a bus electrode (consisting of a metal electrode) of a first maintaining electrode $X_{1,2}$ has a width $W_2$ which is the same as a width $W_1$ of a bus electrode (consisting of a metal electrode) of a second maintaining electrode $Y_1$.

FIG. 3*a*–3*g* are graphs indicating, as one embodiment of the present invention, various different waves of discharge maintaining pulses for driving a plasma display panel having an electrode arrangement shown in FIG. 2.

As is well known, a plasma display panel requires an address period and a discharge maintaining period. In the address period, a selective writing address method or a selective erasing address method is used to accumulate wall electric charges in discharge cells (to be lighted) successively from one displaying line to another, so as to select picture elements to be lighted and picture elements not to be lighted. In the discharge maintaining period, discharge maintaining pulses $IP_x$, $IP_y$ are alternatively applied to first and second maintaining electrodes so as to maintain lighted picture elements and not-lighted picture elements.

Particularly, in the discharge maintaining period it is necessary to prepare two discharge maintaining pulses $IP_{y1}$, $IP_{y2}$ having different phases. In operation, a discharge maintaining pulse $IP_{y1}$ is applied to a maintaining electrode $Y_1$, a discharge maintaining pulse $IP_{y2}$ is applied to a maintaining electrode $Y_2$, a discharge maintaining pulse $IP_{y2}$ is applied to a maintaining electrode $Y_3$, a discharge maintaining pulse $IP_{y1}$ is applied to a maintaining electrode $Y_4$.

This time, an electric current $IY_1$ (shown in FIG. 3*c*) flows through an electrode pair ($Y_1$, $X_{1,2}$), an electric current $IY_2$ (shown in FIG. 3*f*) flows through an electrode pair ($Y_2$, $X_{1,2}$). Thus, it is possible to stagger the timings of a displacement current and a discharge current. In this way, although an electric current $IX_{1,2}$ flowing through the maintaining electrode $X_{1,2}$ is a current including a current $IY_1$ and a current $IY_2$ (as shown in 3*g*), a displacement current and a discharge current are separated in timing from each other to some extent, thus reducing a peak current.

In this way, a peak current may be reduced to its minimum value which is the same as in a condition not involving common electrodes (for example, first electrodes) for two adjacent electrodes (for example, second electrodes). Therefore, although a bus electrode (consisting of a metal electrode) of a first maintaining electrode X has a width $W_2$ which is as narrow as the width $W_1$ of a bus electrode (consisting of a metal electrode) of a second maintaining electrode Y, there will be no increased voltage drop and no deterioration in displaying quality.

It has been proved that a plasma display panel to be driven by the driving waves shown in FIG. 3 is allowed to have its bus electrodes made smaller than prior art, i.e., the area of each bus electrode is allowed to be made only ¾ of a conventional one. Further, the plasma display panel driven by the driving waves shown in FIG. 3 has been proved to have an improved numerical aperture and an improved efficiency of light emission.

FIG. 4*a*–4*g* are graphs indicating, as a second embodiment of the present invention, various different waves of discharge maintaining pulses for driving a plasma display panel having an electrode arrangement shown in FIG. 2.

There is only one difference between two embodiments shown in FIGS. 3 and 4. That is, a discharge maintaining pulse IPx being applied to first maintaining electrodes ($X_{1,3}$, $X_{3,4}$) has a phase made different from both the discharge maintaining pulses $IP_{y1}$ and $IP_{y2}$.

Similarly, in the discharge maintaining period it is necessary to have two discharge maintaining pulses $IP_{y1}$, $IP_{y2}$ (for being applied to two second maintaining electrodes $Y_{1,2}$) having different phases from each other, further it is necessary to have a discharge maintaining pulse $IP_x$ (for being applied to first maintaining electrodes $X_{1,2}$, $X_{3,4}$) having a phase different from both pulses $IP_{y1}$, $IP_{y2}$.

In operation, a discharge maintaining pulse $IP_{y1}$ is applied to maintaining electrodes $Y_1$, $Y_4$, a discharge maintaining pulse $IP_{y2}$ is applied to maintaining electrodes $Y_2$, $Y_3$, a discharge maintaining pulse $IP_x$ is applied to maintaining electrodes $X_{1,2}$, $X_{3,4}$.

This time, an electric current $IY_1$ (shown in FIG. 4*c*) flows through an electrode pair ($Y_1$, $X_{1,2}$), an electric current $IY_2$ (shown in FIG. 4*f*) flows through an electrode pair ($Y_2$, $X_{1,2}$). Thus, it is possible to stagger the timings of a displacement current and a discharge current. In this way, although an electric current $IX_{1,2}$ flowing through the maintaining electrode $X_{1,2}$ is a current including a current $IY_1$ and a current $IY_2$ (as shown in 4*g*), a displacement current and a discharge current are separated in timing from each other to some extent, thus reducing a peak current.

In this way, a peak current may be reduced to its minimum value which is the same as in a condition not involving common electrodes (for example, first electrodes) for two adjacent electrodes (for example, second electrodes). Therefore, although a bus electrode (consisting of a metal electrode) of a first maintaining electrode X has a width $W_2$ which is as narrow as the width W1 of a bus electrode (consisting of a metal electrode) of a second maintaining electrode Y, there will be no increased voltage drop and no deterioration in displaying quality.

It has been proved that a plasma display panel to be driven by the driving waves shown in FIG. 4 is allowed to have its bus electrodes made smaller than prior art, i.e., the area of each bus electrode is allowed to be made only ¾ of a conventional one. Further, the plasma display panel driven by the driving waves shown in FIG. 4 has been proved to have an improved numerical aperture and an improved efficiency of light emission.

Figure 5:
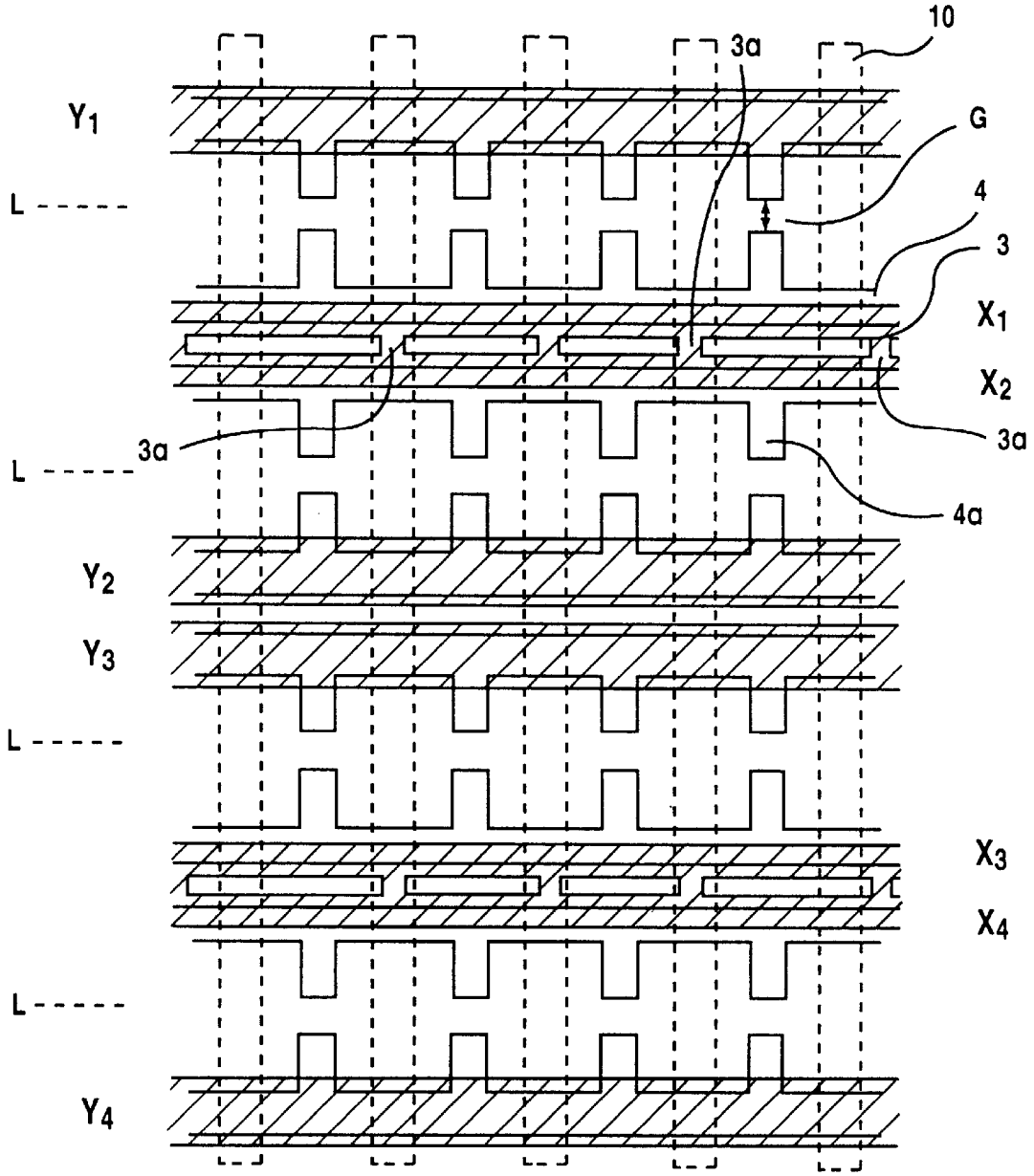
FIG. 5 is a plane view schematically illustrating the structure of a surface-discharge type plasma display panel to be driven by the driving waves shown in FIG. 3 or FIG. 4.

FIG. 5 is a plane view showing a structure of a panel-discharge type plasma display panel to be driven by driving waves indicated in FIG. 3 or FIG. 4.

As shown in FIG. 5, a first and a second maintaining electrodes (X,Y) which together form a row electrode pair on a displaying line L, have their mutual positional relationship changed alternatively from one displaying line L to another. Maintaining electrodes (for example, $X_1$, $X_2$ and $X_3$, $X_4$) which receive an identical drive signal, are connected to each other (in short circuit) through at least one connecting means 3*a*.

With the use of the surface-discharge type plasma display panel shown in FIG. 5, since two adjacent bus electrodes 3,3 are connected to each other through at least one connecting means 3*a*, even if one maintaining electrode on one side is disconnected, it is still possible to maintain a displaying performance on a displaying line having the disconnected electrode. Moreover, if there are two or more connecting means 3*a*, it is possible to maintain a displaying performance on a displaying line even if two electrodes are disconnected. As shown in FIG. 5, since the maintaining electrodes (for example, $X_1$,$X_2$ and $X_3$, $X_4$) each has an increased electrode width (twice as wide as that in a prior art), a voltage drop is reduced and a picture quality improved.

Referring again to FIG. 5, each transparent electrode 4 partially forming a maintaining electrode, as shown in FIG. 5, has a plurality of projections 4*a* each protruding towards a discharge gap G in each discharge cell, such that two projections (4*a*,4*a*) of two mutually facing transparent electrodes (4, 4) are caused to face each other with a discharge gap G therebetween.

Further, the connecting means 3*a* may be comprised of a transparent electrically conductive film connecting together two adjacent transparent electrodes 4 of two first maintaining electrodes (for example, $X_1$ and $X_2$, $X_3$ and $X_4$). In such a case, a connecting means 3*a* is allowed to be made of a material which is identical as the transparent electrodes 4. When the connecting means 3*a* is made of a material identical as the transparent electrodes 4, it will be easy for two projections 4*a* of two mutually facing transparent electrodes 4 to be alined with each other, so that every two corresponding projections 4*a* are caused to face and line up with each other with a discharge gap G formed therebetween, as shown in FIG. 5.

In use of the above surface-discharge type plasma display panel shown in FIG. 5, during a discharge maintaining period, it is necessary to have two discharge maintaining pulses $IP_{y1}$, $IP_{y2}$, having different phases. In operation, a discharge maintaining pulse $IP_{y1}$ is applied to a maintaining electrode $Y_1$, a discharge maintaining pulse $IP_{y2}$ is applied to a maintaining electrode $Y_2$, a same discharge maintaining pulse $IP_{y2}$ is applied to a maintaining electrode $Y_3$, a discharge maintaining pulse $IP_{y1}$ is applied to a maintaining electrode $Y_4$.

In this way, a peak current may be reduced to its minimum value, and there will be no increased voltage drop and no deterioration in displaying quality.

It has been proved that a plasma display panel to be driven by the driving waves shown in FIG. 3 or FIG. 4 is allowed to have its bus electrodes made smaller than prior art, i.e., the area of each bus electrode is allowed to be made only ¾ of a conventional one. Further, the plasma display panel driven by the driving waves shown in FIG. 3 or FIG. 4 has been proved to have an improved numerical aperture and an improved efficiency of light emission.

Figure 6:
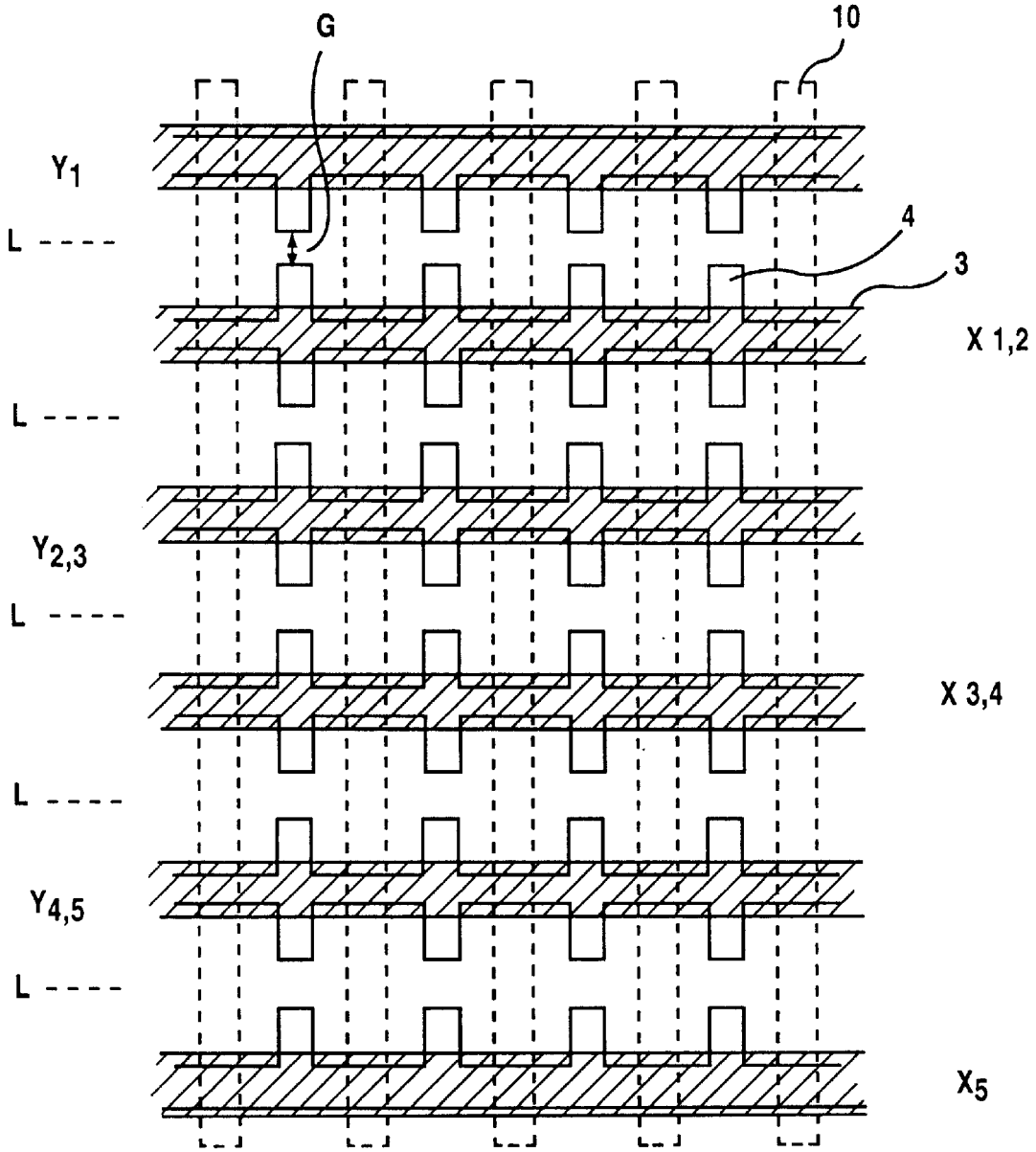
FIG. 6 is a plane view schematically illustrating a structure of a surface-discharge type plasma display panel to be driven in a method according to another embodiment of the present invention.
Figures 7A, 7B, 7C, 7D, 7E, 7F, 7G, 7H, 7I, 7J, 7K, 7L:
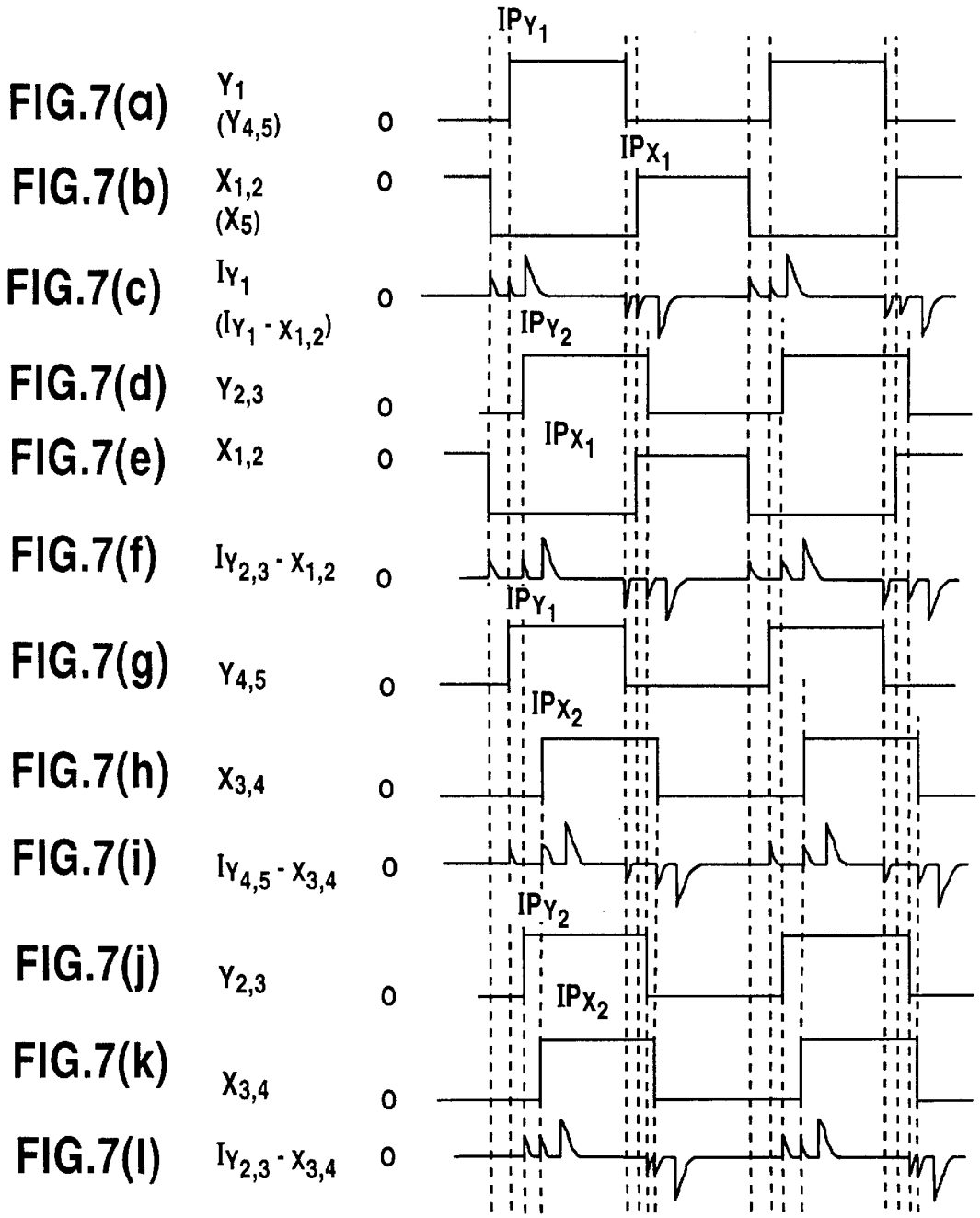
FIGS. 7*a*–7*l* are graphs indicating driving waves for driving the surface-discharge type plasma display panel of FIG. 6.

FIG. 6 is a plane view showing another structure of a surface-discharge type plasma display panel to be driven in a method according to a third embodiment of the present invention.

As shown in FIG. 6, a first and a second maintaining electrodes (X,Y) which together form a row electrode pair on a displaying line L, have their mutual positional relationship changed alternatively from one displaying line L to another. Each maintaining electrode (for example, $X_{1,2}$) is positioned between two maintaining electrodes ($Y_1$,$Y_2$) so as to serve as a common electrode (equal to two maintaining electrodes $X_1$, $X_2$) for the two maintaining electrodes ($Y_1$, $Y_2$).

FIG. 7*a*–7*l* are graphs indicating, as a third embodiment of the present invention, various different waves of discharge maintaining pulses for driving a plasma display panel having an electrode arrangement shown in FIG. 6.

Similarly, as is well known, a plasma display panel requires an address period and a discharge maintaining period. In the address period, a selective writing address method or a selective erasing address method is used to accumulate wall electric charges in discharge cells (to be lighted) successively from one displaying line to another, so as to select picture elements to be lighted and picture elements not to be lighted. In the discharge maintaining period, discharge maintaining pulses are alternatively applied to first and second maintaining electrodes so as to maintain lighted picture elements and not-lighted picture elements.

Particularly, in the discharge maintaining period, it is necessary to have two discharge maintaining pulses $IP_{y1}$, $IP_{y2}$ having different phases, it is also necessary to have two discharge maintaining pulses $IP_{x1}$, $IP_{x2}$ having different phases. In operation, a discharge maintaining pulse $IP_{y1}$ is applied to a maintaining electrode $Y_1$, a discharge maintaining pulse $IP_{x1}$ is applied to a maintaining electrode $X_{1,2}$ a same discharge maintaining pulse $IP_{y2}$ is applied to a maintaining electrode $Y_{2,3}$, a discharge maintaining pulse $IP_{x2}$ is applied to a maintaining electrode $X_{3,4}$, a discharge maintaining pulse $IP_{y1}$ is applied to a maintaining electrode $Y_{4,5}$, a discharge maintaining pulse $IP_{x1}$ is applied to a maintaining electrode $X_5$.

This time, an electric current $IY_1$ (shown in FIG. 7*c*) flows through an electrode pair ($Y_1$, $X_{1,2}$), an electric current $IY_{2,3}$-$X_{1,2}$ (shown in FIG. 7*f*) flows through an electrode pair ($Y_{2,3}$, $X_{1,2}$), an electric current $IY_{4,5}$-$X_{3,4}$ (shown in FIG. 7*i*) flows through an electrode pair ($Y_{4,5}$, $X_{3,4}$), an electric current $IY_{2,3}$-$X_{3,4}$ (shown in FIG. 7*l*) flows through an electrode pair ($Y_{2,3}$, $X_{3,4}$). Thus, it is possible to stagger the timings of a displacement current and a discharge current.

FIGS. 8*a*–8*d* are graphs indicating various different discharge currents caused by different driving pulses.

In this way, flowing into maintaining electrodes $X_{1,2}$ is an electric current $IX_{1,2}$ obtained by adding together a current $IY_1$ and a current $IY_{2,3}$-$X_{1,2}$ (shown in FIG. 8*a*), flowing into maintaining electrodes $Y_{2,3}$ is an electric current IY2.3 obtained by adding together a current $IY_{2,3}$,-$X_{1,2}$ and a current $IY_{2,3}$-$X_{3,4}$ (shown in FIG. 8*b*), flowing into maintaining electrodes $X_{3,4}$ is an electric current $IX_{3,4}$ obtained by adding together a current $IY_{4,5}$-$X_{3,4}$ and a current $IY_{2,3}$-$X^{3,4}$ (shown in FIG. 8*c*), flowing into maintaining electrodes $X_{4,5}$, is an electric current $IY_{4,5}$ obtained by adding together a current $IY_{4,5}$-$X_{3,4}$ and a current $IY_{4,5}$-$X_5$ (shown in FIG. 8*d*). Therefore, a displacement current and a discharge current may be separated in timing from each other to some extent, thus reducing a peak current.

In this way, a peak current may be reduced to its minimum value which is the same as in a condition not involving common electrodes (for example, first electrodes) for two adjacent electrodes (for example, second electrodes). Therefore, although a bus electrode (consisting of a metal electrode) of a first maintaining electrode X has a width $W_2$ which is as narrow as the width W1 of a bus electrode (consisting of a metal electrode) of a second maintaining electrode Y, there will be no increased voltage drop and no deterioration in displaying quality.

In the above plasma display panel shown in FIG. 6, since each of first maintaining electrodes (for example, $X_{1,2}$ or $X_{3,4}$) is placed between two second maintaining electrodes (for example $Y_{2,3}$ and $Y_{4,5}$) so as to server as a common electrode (equal to two maintaining electrodes $X_1$, $X_2$) for the two second maintaining electrodes $Y_{2,3}$ and $Y_{4,5}$ (each serving as a common electrode equal to two electrodes $Y_2$, $Y_3$ or $Y_4$,$Y_5$), it is allowed to have its bus electrodes made smaller than prior art, i.e., the area of each bus electrode is only ½ of a conventional one. Further, the plasma display panel shown in FIG. 6 has been proved to have an improved numerical aperture and an improved efficiency of light emission.

Figure 9:
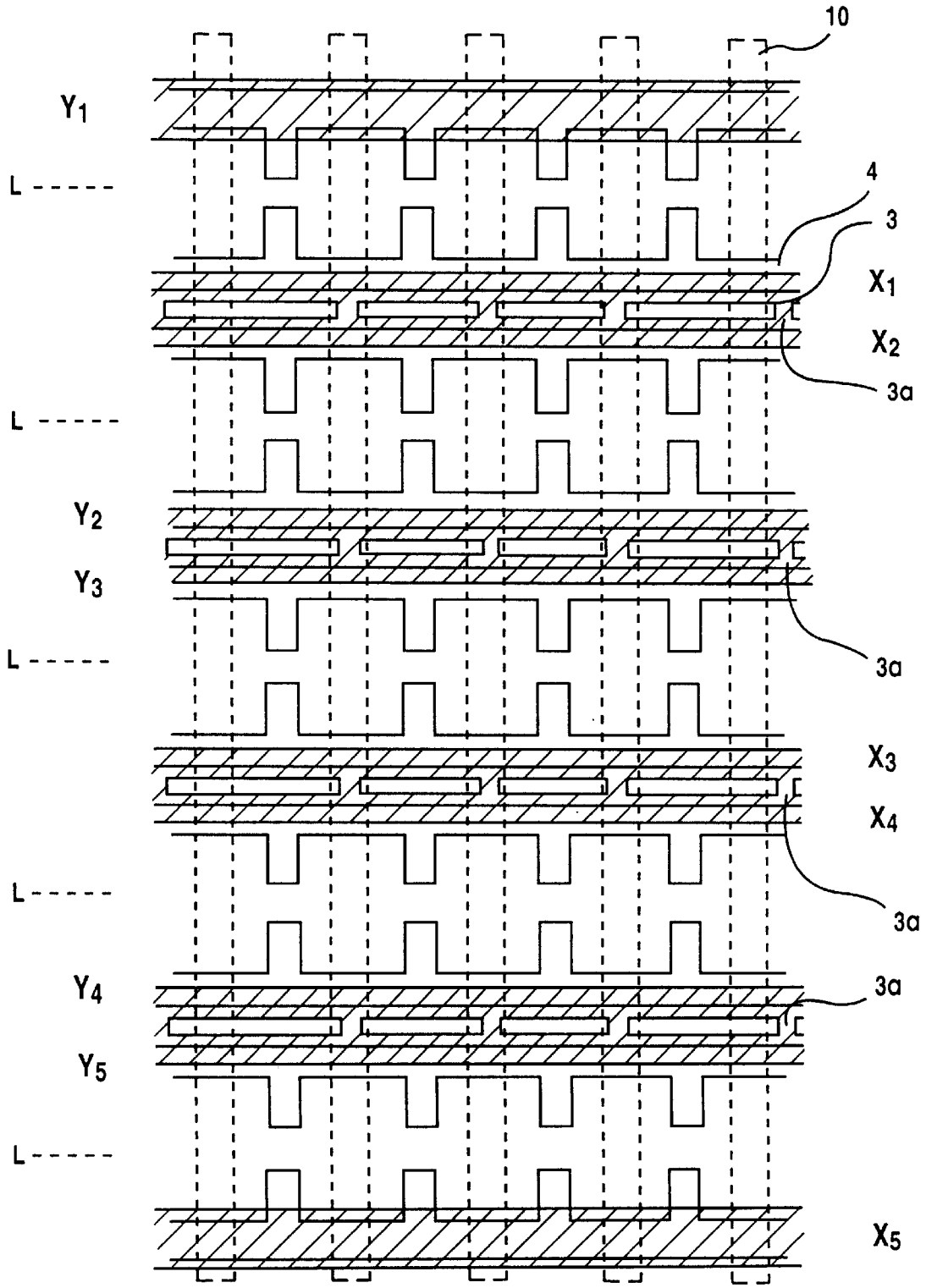
FIG. 9 is a plane view schematically illustrating another structure of a surface-discharge type plasma display panel to be driven by the driving waves shown in FIG. 7.
Figure 10:
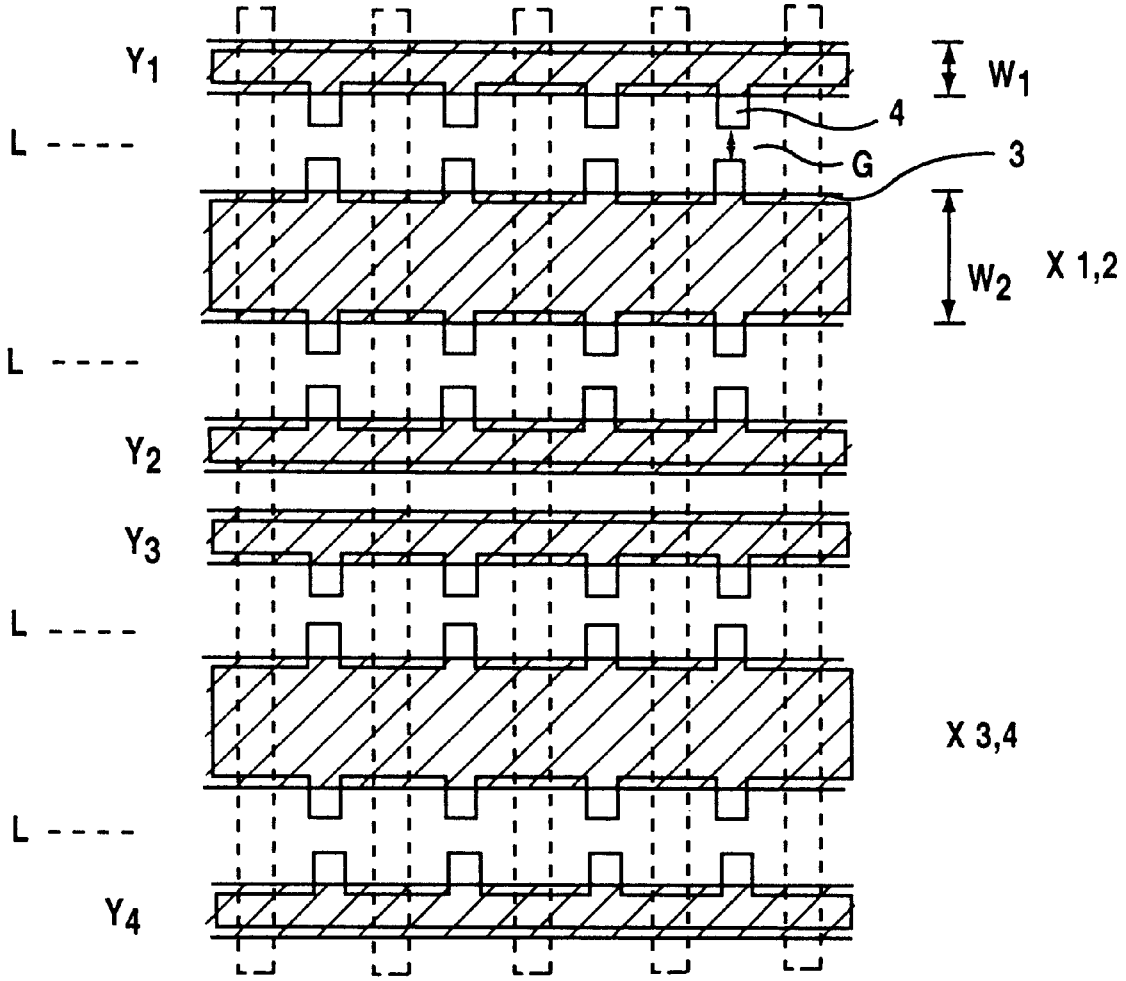
FIG. 10 is a plane view schematically illustrating a structure of a surface-discharge type plasma display panel according to a prior art.
Figure 11:
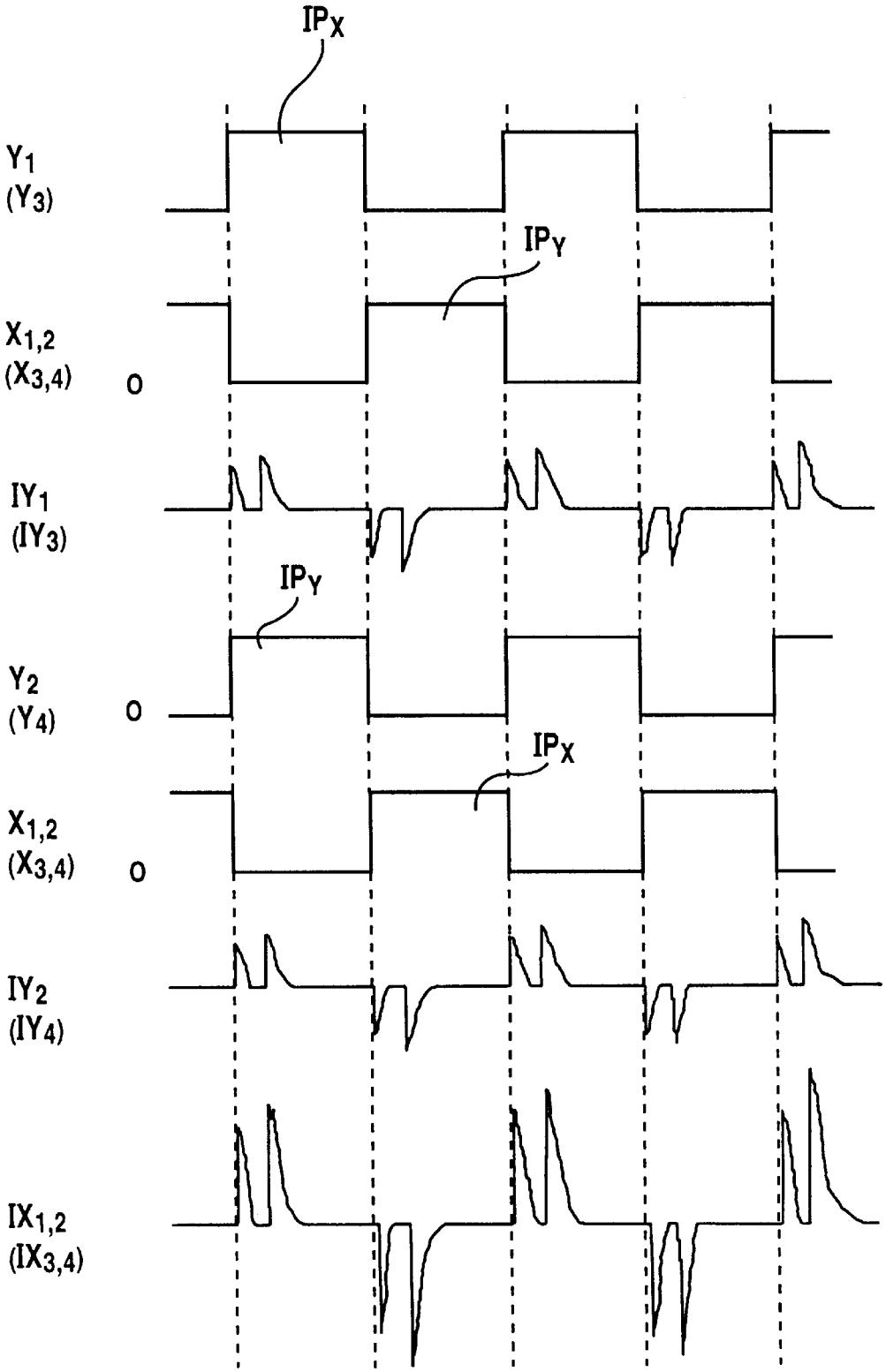
FIG. 11 is a graph indicating driving waves for driving the conventional surface-discharge type plasma display panel of FIG. 10.

FIG. 9 is a plane view showing another structure of a surface-discharge type plasma display panel which is driven by driving pulses indicated in FIG. 7.

As shown in FIG. 9, a first and a second maintaining electrodes (X,Y) which together form a row electrode pair on a displaying line L , have their mutual positional relationship changed alternatively from one displaying line L to another. Maintaining electrodes (for example, $X_1$, $X_2$ and $X_3$, $X_4$) are connected to each other (in short circuit) through at least one connecting means 3*a*. Further, maintaining electrodes (for example, $Y_2$, $Y_3$ and $Y_4$, $X_5$), are also connected to each other (in short circuit) through at least one connecting means 3*a*.

In the discharge maintaining period, it is necessary to have two discharge maintaining pulses $IP_{y1}$, $IP_{y2}$ having different phases, it is also necessary to have two discharge maintaining pulses $IP_{x1}$, $IP_{x2}$ having different phases. In operation, a discharge maintaining pulse $IP_{y1}$ is applied to a maintaining electrode $Y_1$, a discharge maintaining pulse $IP_{x1}$ is applied to a maintaining electrode $X_{1,2}$, a same discharge maintaining pulse $IP_{y2}$ is applied to a maintaining electrode $Y_{2,3}$, a discharge maintaining pulse $IP_{x2}$ is applied to a maintaining electrode $X_{3,4}$, a discharge maintaining pulse $IP_{y1}$ is applied to a maintaining electrode $Y_{4,5}$, a discharge maintaining pulse $IP_{x1}$ is applied to a maintaining electrode $X_5$. In this way, it is possible to obtain the same effects as obtained in the plasma display panel shown in FIG. 6.

While the presently preferred embodiments of the this invention have been shown and described above, it is to be understood that these disclosures are for the purpose of illustration and that various changes and modifications may be made without departing from the scope of the invention as set forth in the appended claims.

What is claimed is:

1. A method of driving a surface-discharge type plasma display panel which comprises a plurality of displaying lines each including a first maintaining electrode and a second maintaining electrode to form a discharge gap therebetween, a dielectric layer coverring the first and second maintaining electrodes, a plurality of address electrodes arranged in a direction orthogonal to the first and second maintaining electrodes to form a plurality of picture elements, said method comprising:

providing an address period for selecting picture elements to be lighted and picture elements not to be lighted in accordance with displaying data;

providing a discharge maintaining period for alternatively applying discharge maintaining pulses to first and second maintaining electrodes so as to maintain lighted picture elements and not-lighted picture elements;

applying two discharge maintaining pulses, having different phases to every two second maintaining electrodes between which there is a first maintaining electrode serving as a common electrode for the two second maintaining electrodes.

2. A method according to claim 1, wherein each of a first maintaining electrode and a second maintaining electrode is comprised of a transparent electrically conductive film and a metal film laminated over the transparent electrically conductive film.

3. A method according to claim 1 or 2, wherein each transparent electrically conductive film has a plurality of protruding portions, in a manner such that on each displaying line the protruding portions of first and second maintaining electrodes are facing each other with a discharging gap therebetween.

4. A method of driving a surface-discharge type plasma display panel which comprises a plurality of displaying lines each including a first maintaining electrode and a second maintaining electrode to form a discharge gap therebetween, a dielectric layer coverring the first and second maintaining electrodes, a plurality of address electrodes arranged in a direction orthogonal to the first and second maintaining electrodes to form a plurality of picture elements, said method comprising:

providing an address period for selecting picture elements to be lighted and picture elements not to be lighted in accordance with displaying data;

providing a discharge maintaining period for alternatively applying discharge maintaining pulses to first and second maintaining electrodes so as to maintain lighted picture elements and not-lighted picture elements;

applying two discharge maintaining pulses having different phases to every two second maintaining electrodes between which there are two first maintaining electrodes electrically connected together through at least one connecting means.

5. A method according to claim 4, wherein each of a first maintaining electrode and a second maintaining electrode is comprised of a transparent electrically conductive film and a metal film laminated over the transparent electrically conductive film.

6. A method according to claim 4 or 5, wherein each transparent electrically conductive film has a plurality of protruding portions, in a manner such that on each displaying line the protruding portions of first and second maintaining electrodes are facing each other with a discharging gap therebetween.

* * * * *